US006591426B1

(12) United States Patent
Smith

(10) Patent No.: US 6,591,426 B1
(45) Date of Patent: Jul. 15, 2003

(54) SLEEPING BAG

(75) Inventor: Ronald William Smith, Cambuslang (GB)

(73) Assignee: Lomond House International Limited, Coatbridge (GB)

( * ) Notice: Subject to any disclaimer, the term of this patent is extended or adjusted under 35 U.S.C. 154(b) by 0 days.

(21) Appl. No.: 09/889,619

(22) PCT Filed: Jan. 21, 2000

(86) PCT No.: PCT/GB00/00158

§ 371 (c)(1),
(2), (4) Date: Jan. 3, 2002

(87) PCT Pub. No.: WO00/42887

PCT Pub. Date: Jul. 27, 2000

(30) Foreign Application Priority Data

Jan. 21, 1999 (GB) ..... 9901201
Feb. 11, 1999 (GB) ..... 9902974

(51) Int. Cl.[7] ..... A41D 15/04
(52) U.S. Cl. ..... 2/69; 2/69.5; 2/80; 5/343
(58) Field of Search ..... 2/69, 69.5, 79, 2/88, 84, 80, 83; 5/413, 42 B, 44 B, 417, 419, 414

(56) References Cited

U.S. PATENT DOCUMENTS 3,924,273 A * 12/1975 Donovan ..... 2/69.5
4,125,910 A * 11/1978 Nicholai ..... 2/69.5
4,158,892 A * 6/1979 Gonzales ..... 2/69.5
4,206,512 A * 6/1980 Osborne ..... 2/69.5
4,236,263 A * 12/1980 Allee ..... 5/41.3
4,507,805 A * 4/1985 Calutoiu ..... 2/69.5
4,759,082 A * 7/1988 Mulligan ..... 2/69.5
4,774,734 A * 10/1988 Mills ..... 5/41.3
4,856,131 A * 8/1989 Mills ..... 5/41.3
5,226,193 A * 7/1993 Chen ..... 2/69.5
5,515,559 A * 5/1996 Benson ..... 5/41.3
5,560,043 A * 10/1996 Armstrong ..... 2/69.5
6,343,968 B1 * 2/2002 Louie et al. ..... 2/69.5

OTHER PUBLICATIONS

International Search Report dated May 25, 2000, for application Ser. No. PCT/GB00/00158.

* cited by examiner

*Primary Examiner*—Gloria M. Hale
(74) *Attorney, Agent, or Firm*—Moser, Patterson & Sheridan, L.L.P.

(57) ABSTRACT

A sleeping bag configured to represent a human or fantasy subject, such as a sportsperson; e.g. a football (soccer) player. The sleeping bag has arm and leg portions and has surface decoration representing the subject; e.g. the football strip of a particular club. The surface decoration may be provided by printing and may include features such as the bottoms of trousers and tops of socks represented by pleats or tucks. The outer surface of the sleeping bag may incorporate a pocket portion to permit over-printing of the sleeping bag subsequent to manufacture (e.g.) at the point of purchase).

18 Claims, 6 Drawing Sheets

SLEEPING BAG

The present invention relates to a sleeping bag. More particularly, the invention relates to a sleeping bag having a novel configuration and having any one of a variety of surface decorations whereby the sleeping bag provides the user with a type of costume representing any kind of human, animal or fantasy subject.

In accordance with the present invention there is provided a sleeping bag having first and second arm portions extending from a main body portion thereof and including surface decoration representing a human, animal or fantasy subject.

In certain embodiments, the ends of said arm portions are closed by end portions, which may be detachable from the arm portions.

Preferably, the sleeping bag further includes first and second leg portions. In certain embodiments, the ends of said leg portions are closed by end portions, which may be detachable from the leg portions.

In certain embodiments, the sleeping bag further includes a hood portion.

The sleeping bag may be shaped, such as by means of padding, in a manner associated with the subject of the surface decoration, and/or may include additional structural features associated with the subject of the surface decoration. Such structural features may be rigid or semi-rigid.

The surface decoration may include elements provided by weaving and/or printing and/or applied fabrics. The surface decoration may be applied directly to the fabric of the sleeping bag or may comprise a separate cover for the sleeping bag.

Preferably, the surface decoration is applied, at least in part by screen-printing. Preferably also, features of the surface decoration are provided by pleats or tucks formed in an outer envelope of the sleeping bag.

Preferably, the sleeping bag includes closure means connecting with a neck opening of the bag to facilitate entry to and exit from the bag. Most preferably, the closure means extends along a shoulder and arm portion of the bag.

Embodiments of the invention will now be described, by way of example only, with reference to the accompanying drawings in which.

Figure 1:
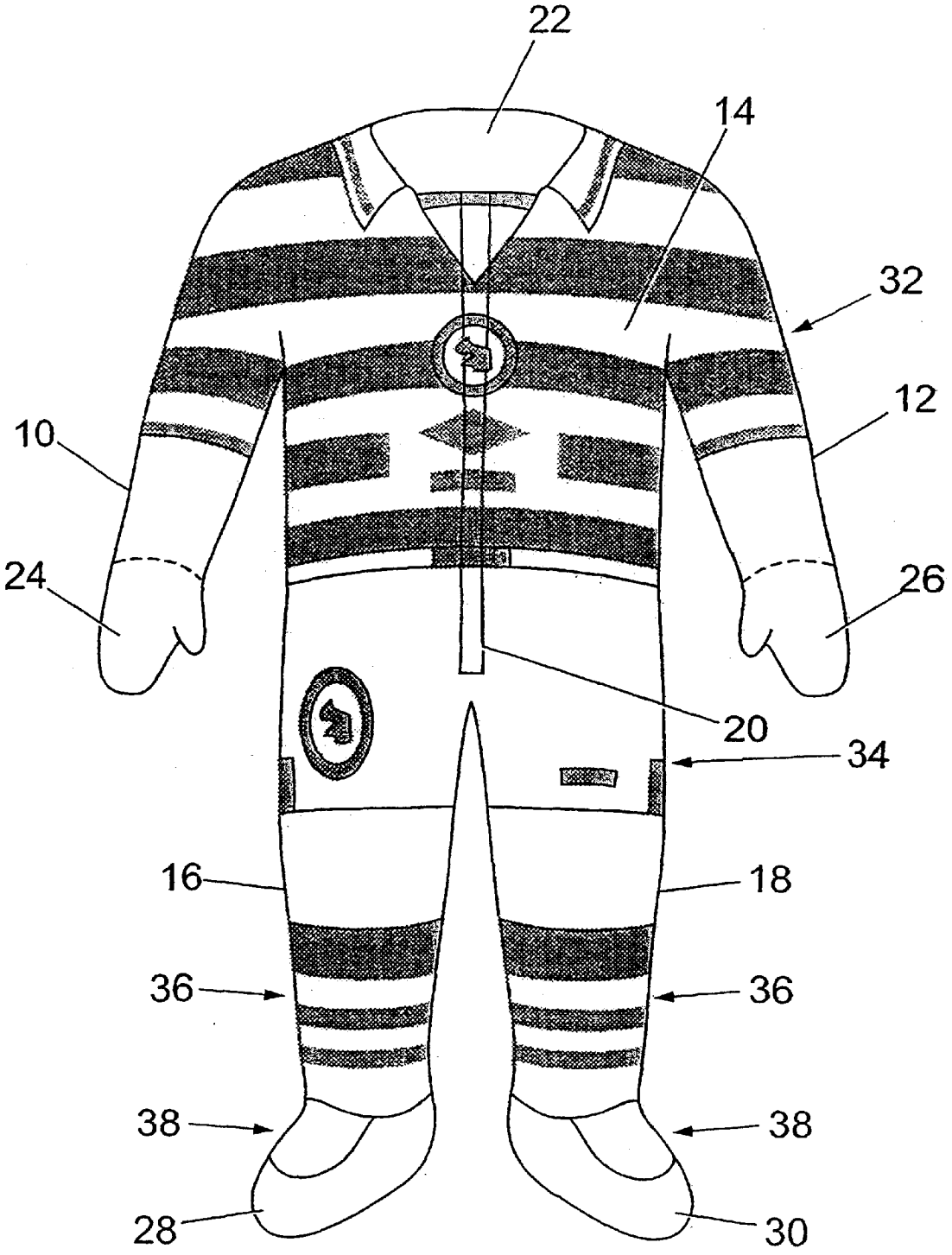
FIG. 1 is a plan view of a first example of a sleeping bag embodying the invention.

Referring to FIG. 1 of the drawings, a sleeping bag in accordance with the invention comprises a padded or quilted envelope of textile material which may be similar in terms of basic construction and materials to any conventional type of sleeping bag. The sleeping bag in accordance with the present invention differs from conventional sleeping bags by having first and second arm portions 10 and 12 extending from a main body portion 14 of the bag. In preferred embodiments, the lower portion of the main body portion 14 is further divided into first and second leg portions 16 and 18. The sleeping bag further includes any suitable type of closure to facilitate the user entering and leaving the bag, such as a zip fastener 20 or the like extending downwardly from a neck opening 22 at the upper end of the main body portion 14. The position of the closure may vary, and other types of closures such as press studs, "Velcro" (RTM, also referred to as "hook-and-loop fastening") etc.

The ends of the arm portions 10, 12 and/or the leg portions 16, 18 may be open or closed. Where closed, the end portions may be detachable as indicated by the dotted lines on the arms 10 and 12 (i.e. in the form of gloves/mitts or booties).

Further in accordance with the invention, the sleeping bag is provided with surface decoration so that the sleeping bag provides a form of costume. In this example the sleeping bag is decorated to represent an association football (soccer) player. That is, the sleeping bag is decorated to simulate the playing strip of a football player of a particular club, with representations of the shirt 32, shorts 34, socks 36 and boots 38 in the appropriate colours and patterns, and may include club badges, sponsors' logos etc. The strip may represent that of a particular player, including the appropriate team number and player's name (normally on the back of the shirt, not shown).

The surface decoration may be applied by any suitable method including being woven into the fabric of the basic sleeping bag, printed onto the sleeping bag, or by additional fabric applied to the basic sleeping bag, or by any combination of these or other suitable methods. Alternatively, the surface decoration may take the form of a separate cover, into which the basic sleeping bag may be inserted. Such a cover could be removable from the basic sleeping bag.

Besides football players, the configuration and surface decoration of the sleeping bag may be varied to represent any suitable human, animal or fantasy subjects.

Such subjects may include, but are not restricted to:

(a) Sporting figures, including but not restricted to the following sports: Association Football (Soccer), Rugby, American Football, Australian Rules Football, Basketball, Baseball, Hockey, Ice Hockey, Motor Racing, Motor Cycling, Tennis, Squash, Badminton, Golf, Cricket etc.

(b) Particular professions or occupations, including but not restricted to: Soldiers, Sailors, Pilots, Policepersons, Firepersons, Royalty etc.

(c) Celebrities and/or fictional characters.

(d) Historical, and/or religious and/or ethnic figures (national dress etc.).

(e) Any type of animal, bird etc.

(f) Mythical, Fairytale and Fantasy figures and creatures.

(g) Cartoon characters.

Generally speaking, any type of "fancy dress" subject might be represented.

The sleeping bag and/or surface decoration may be manufactured from any of a variety of natural and synthetic fabrics, including but not restricted to: cotton, silk, wool, polyester, nylon, linen etc., together with suitable padding and thermally insulating materials. Polyester is particularly preferred for both outer and inner skins of the sleeping bag and for the padding/insulation thereof. Depending upon the subject of the surface decoration, the sleeping bag might incorporate rigid or semi-rigid structural elements representing features of the subject, formed from padding, foam, plastics etc.

FIGS. 2 to 5 illustrate examples of variations in the basic configuration of the sleeping bag, with the surface decoration omitted for clarity. Parts of these examples corresponding to parts of the example of FIG. 1 are indicated by like reference numerals.

Figure 2:
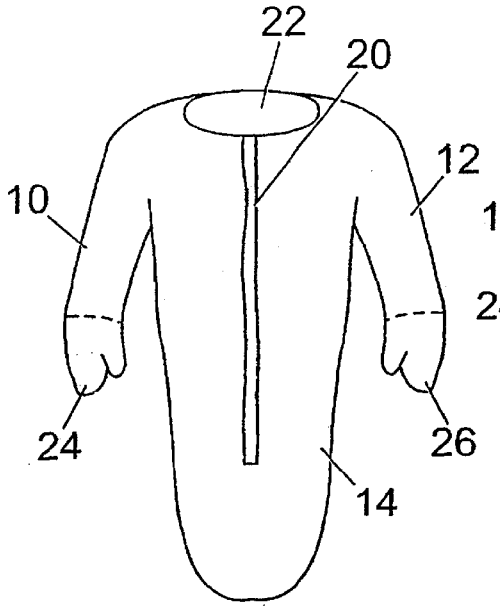
FIGS. 2 to 5 are plan views of further examples of sleeping bags embodying the invention, with surface decoration omitted.

FIG. 2 shows an example including arm portions 10 and 12, but without separate leg portions 16 and 18. However, the use of separate leg portions, as in the other examples, is preferred.

Figure 3:
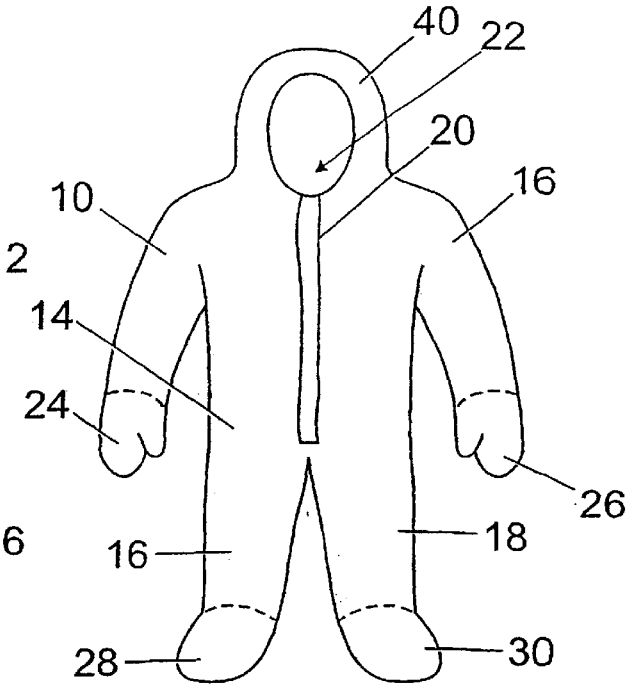

FIG. 3 shows an example similar to FIG. 1, but including a hood portion 40.

Figure 4:
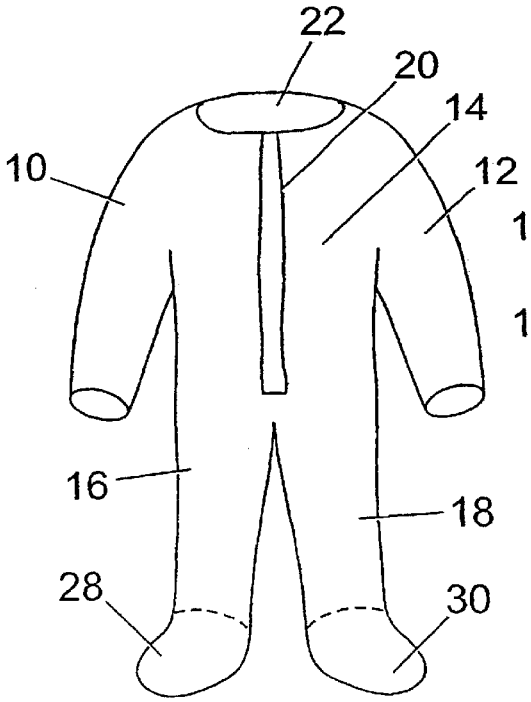

FIG. 4 shows an example similar to FIG. 1, but with open-ended arm portions 10 and 12.

Figure 5:
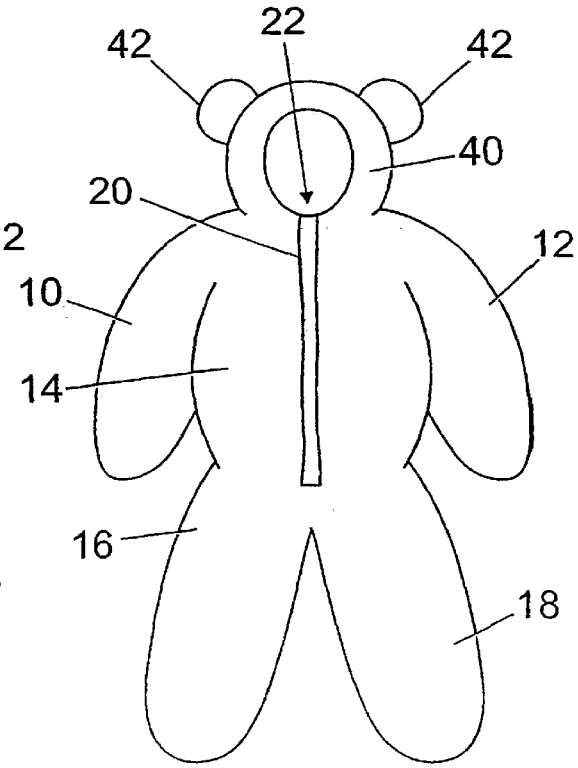

FIG. 5 shows an example in which the sleeping bag is padded to provide a characteristic shape of a subject such as a teddy bear, and provided with additional features such as ears 42.

Sleeping bags in accordance with the invention can be manufactured in a range of sizes to suit different age groups.

It will be appreciated that the basic concept underlying the invention might be applied to a wide variety of subjects, with the basic configuration and structural features of the sleeping bag being determined by the subject.

FIGS. 6 to 9 illustrate a preferred embodiment of the invention. In this particular example, the subject is again an association football player, as in FIG. 1. However, the majority of the surface decoration has been omitted for clarity. It is particularly preferred that, except as detailed below, this surface decoration is applied by means of screen-printing processes, suitably based on photographic source material.

Figure 6:
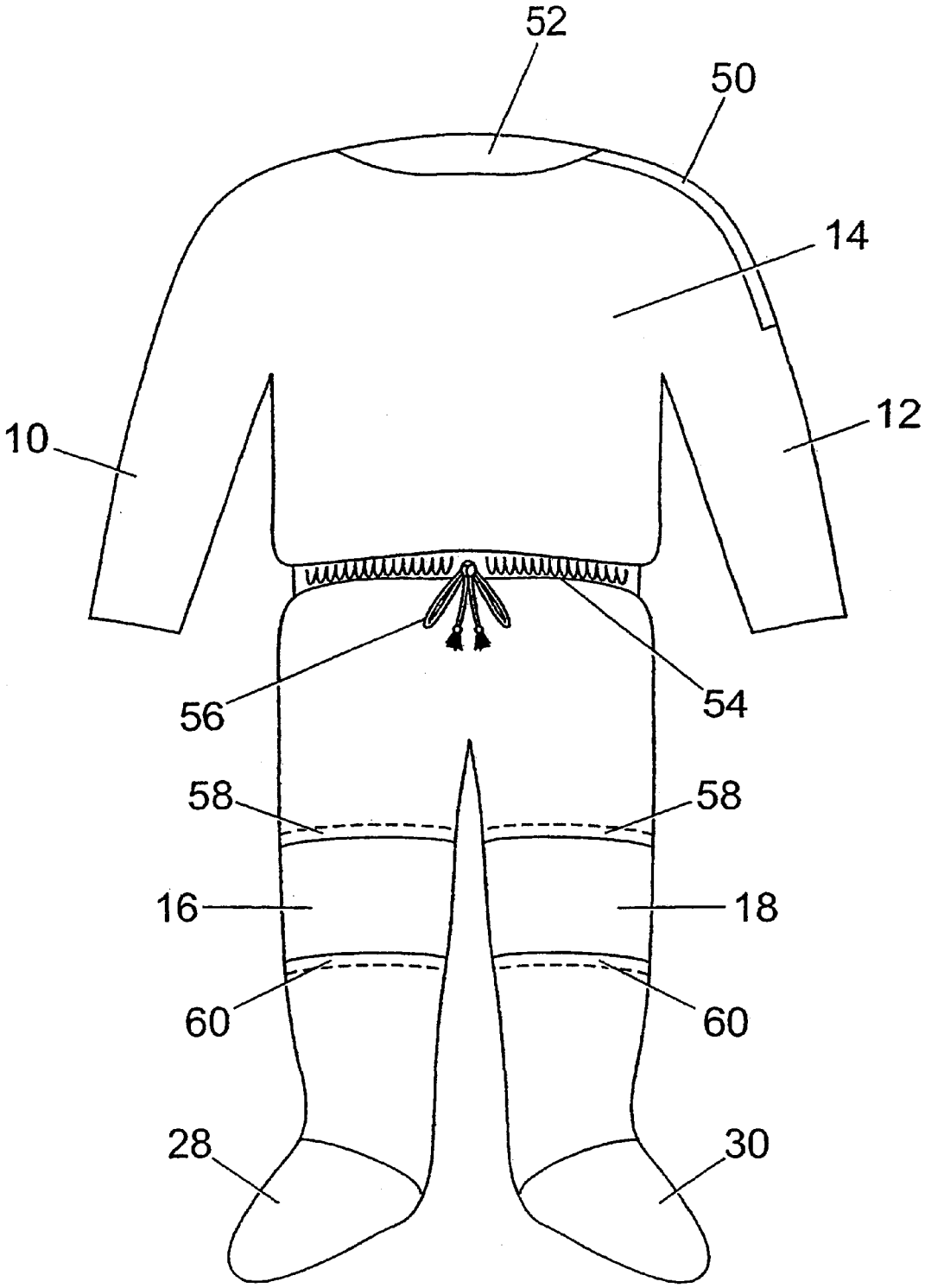
FIG. 6 is a plan view of a preferred embodiment of the invention.

The example of FIG. 6 is generally similar to that of FIG. 1, with the following exceptions.

It is particularly preferred that the closure 50 (which, again, may be a zip fastener or other suitable closure) extends from the neck opening 52, along one shoulder and part way down the adjacent arm portion. This location makes it easy to enter and exit the sleeping bag, and also simplifies manufacture as shall be discussed below.

The arms 10 and 12 are preferably formed without hand portions, and foot portions 28 and 30 are preferably included as an integral part of the sleeping bag.

Apart from graphical decoration applied by printing or the like, the outer envelope of the sleeping bag may incorporate structural features appropriate to the subject of the decoration. In this example, the waist portion 54 is pleated and/or elasticated to simulate the elasticated waistband of a pair of football shorts, and may further include a drawstring 56. Also, the bottoms of the trouser legs and the tops of the socks are represented by pleats or tucks 58 and 60 formed in the outer envelope of the bag.

Figure 7:
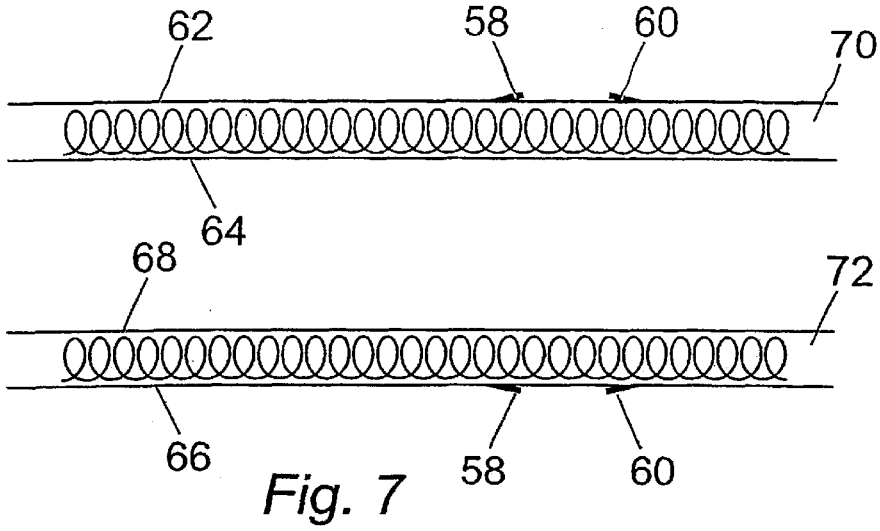
FIG. 7 is a schematic diagram illustrating the preferred construction of the embodiment of FIG. 6.
Figure 8:
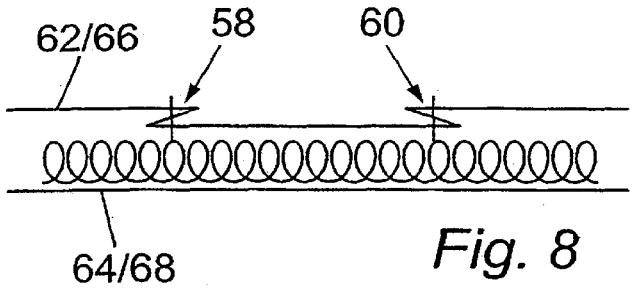
FIG. 8 is an enlarged detail of the construction illustrated in FIG. 7.

It is desirable that the construction of the bag be as simple as possible, consistent with providing a realistic representation of the intended subject. FIG. 7 illustrates, schematically, a preferred construction suitable for the embodiment of FIG. 6.

As seen in FIG. 7, the bag is formed from an upper outer skin 62, and upper inner skin 64, a lower outer skin 66 and a lower inner skin 68. A first layer of thermal insulation 70 is sandwiched between the upper skins 62, 64 and a second layer of thermal insulation 72 is sandwiched between the lower skins 66, 68. Each of the skins 62 to 68 may be substantially similar in shape and size, corresponding to the outline shape of the bag as seen in FIG. 6. Surface decoration features such as the waistband 54 and pleats/tucks 58, 60 may be omitted from the inner skins. Accordingly, the skins may simply be sewn or otherwise attached together around their edges to form the finished bag, with the interior space of the bag being formed between the inner skins 64 and 68. The closure 50 may simply be incorporated into the seam between the upper and lower components.

Figure 9:
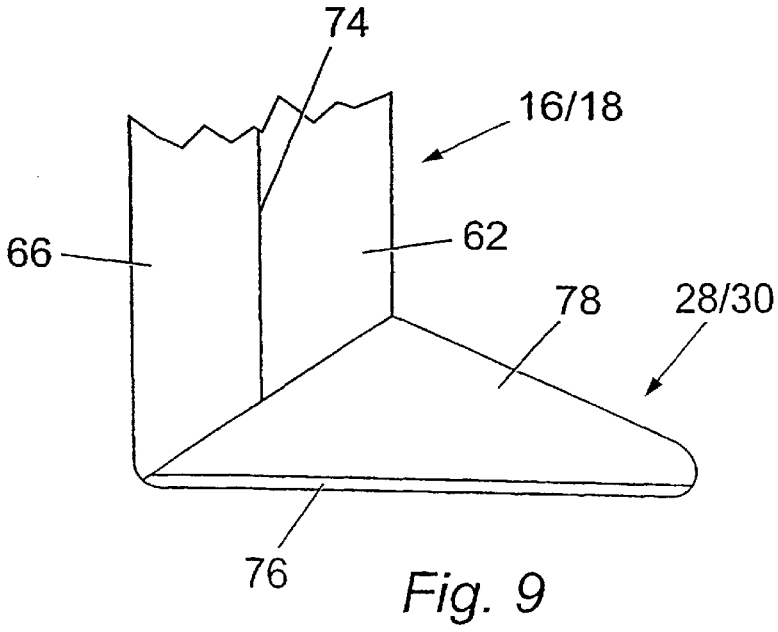
FIG. 9 illustrates the construction of a foot portion of the embodiment of FIG. 6.

FIG. 9 illustrates a preferred construction of the foot portions 28 and 30. The upper and lower halves of the bag have a seam 74 which extends down to the bottom of the leg portions 16 and 18. The bottom ends of the leg portions 16, 18 are angled so that the front of the leg bottom is higher than the back of the leg bottom. A sole portion 76 is attached to the back of the leg bottom at the heel and an upper portion 78 is attached around the remainder of the leg bottom and around the remainder of the periphery of the sole 76. The sole 76 and the upper 78 may have a similar construction to the remainder of the bag, i.e. with inner and outer skins and thermal insulation sandwiched therebetween. It is preferred, however, that the outer surface of the sole portion 76 is formed from a different material from the remainder of the bag, preferably from a relatively hard-wearing, non-slip material, preferably synthetic.

Figure 10:
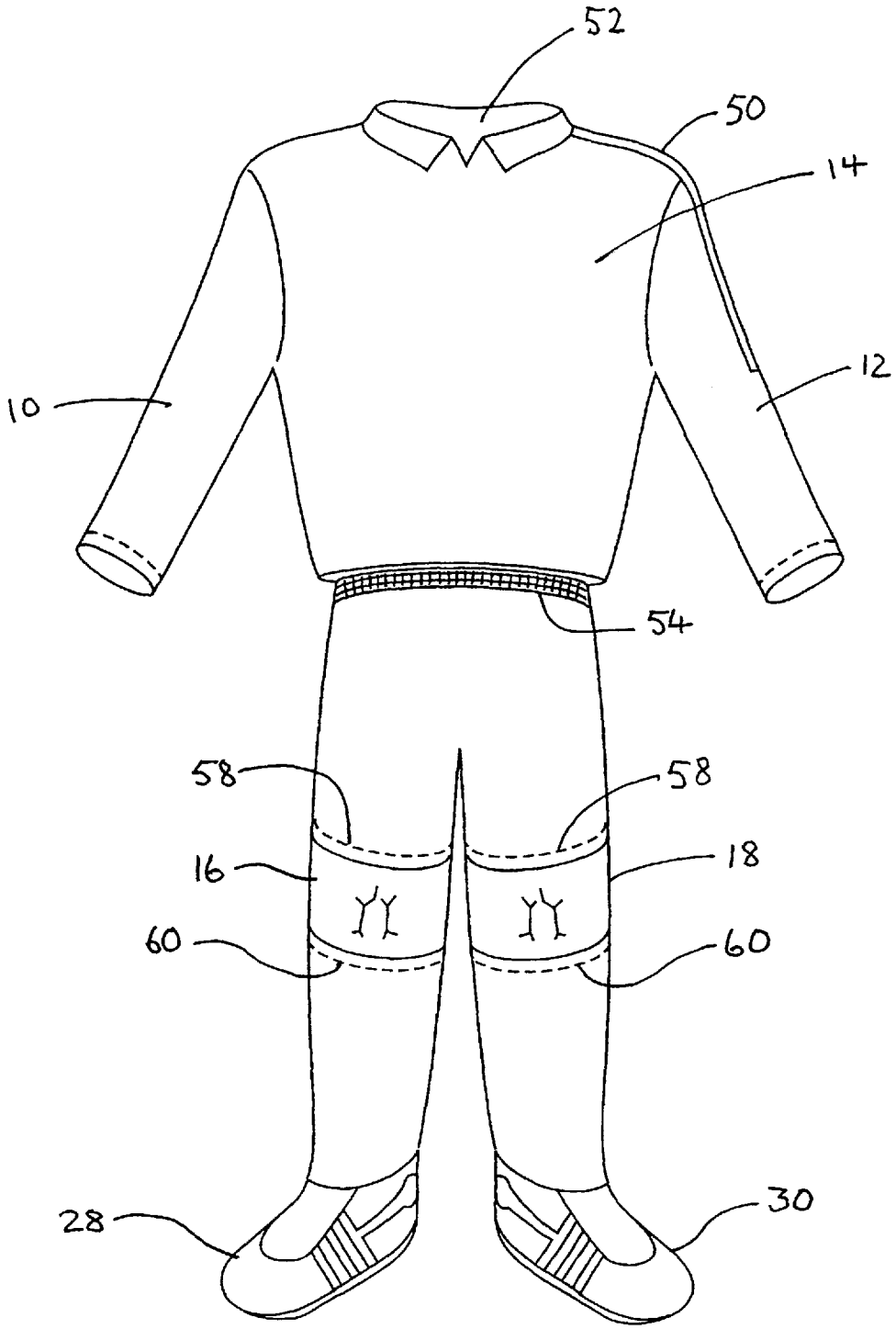
FIGS. 10 and 11 are front and rear views of a particularly preferred embodiment of the invention.
Figure 11:
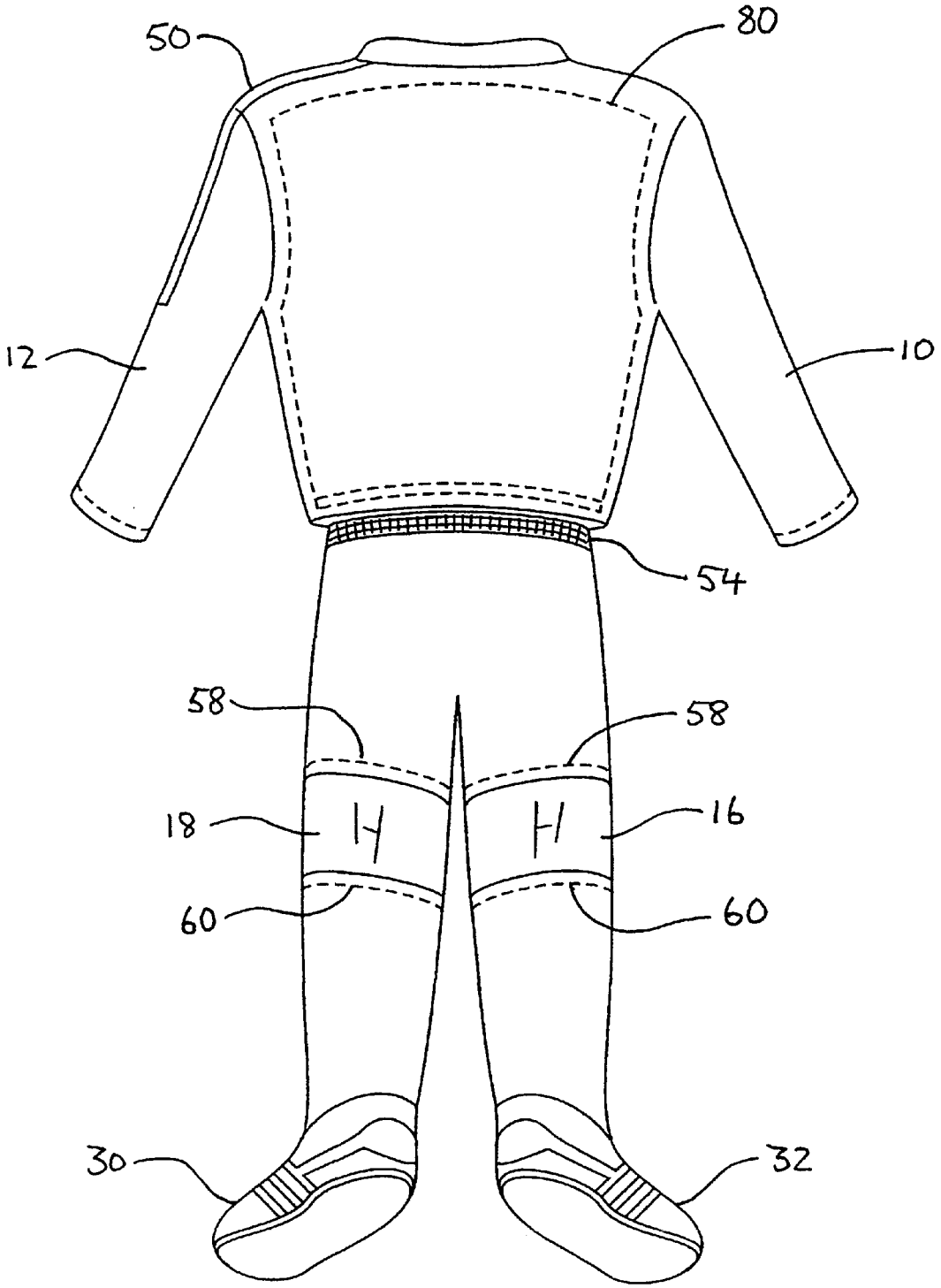

FIGS. 10 and 11 illustrate a oarticularly preferred embodiment of the invention, again representing an association football player and similar to the embodiment of FIGS. 6 to 9.

This embodiment may optionally include a pocket 80 formed in the back of the upper portion of the sleeping bag as seen in FIG. 11. The pocket 80 may be formed by an additional skin of material on the back panel of the upper portion and is preferably open along its lower edge adjacent the waistband 54. The open edge of the pocket maybe closed by suitable fastening means such as VELCRO™, hook and loop fastners, press-studs, zip-fasteners or the like. The pocket allows over-printing of the back panel to allow customisation of the sleeping bag subsequent to manufacture; e.g. at the point of purchase.

It is known to over-print replica football strips at the point of purchase to include, for example, the name and/or number of a particular football player on the back of the shirt. Retail outlets have printing apparatus for this purpose. The provision of the pocket 80 allows the same printing apparatus to be used for over-printing the sleeping bag of the present invention. This would not otherwise be possible due to the bulk of the sleeping bag and the heat generated during the printing process.

A similar pocket could be incorporated into other parts of the sleeping bag where over-printing might be required.

Improvements and modifications may be incorporated without departing from the scope of the invention.

What is claimed is:

1. A sleeping bag having first and second arm portions extending from a main body portion thereof and including surface decoration representing a human, animal or fantasy subject, the bag being formed from first and second outer skins and further including closure means incorporated in a seam between the outer skins, the closure means extending from a neck opening along a shoulder and at least part way along one of the first or second arm portions of the bag to facilitate entry to and exit from the bag.

2. A sleeping bag as claimed in claim 1, wherein said arm portions have ends which are closed by end portions.

3. A sleeping bag as claimed in claim 1, wherein said end portions are detachable from the arm portions.

4. A sleeping bag as claimed in claim 1, further including first and second leg portions.

5. A sleeping bag as claimed in claim 4, wherein said leg portions have ends which are closed by end portions.

6. A sleeping bag as claimed in claim 5, wherein said end portions are detachable from the leg portions.

7. A sleeping bag as claimed in claim 1, further including a hood portion.

8. A sleeping bag as claimed in claim 1, wherein the sleeping bag is shaped in a manner associated with a subject of the surface decoration.

9. A sleeping bag as claimed in claim 1, wherein the sleeping bag includes additional structural features associated with a subject of the surface decoration.

10. A sleeping bag as claimed in claim 1, wherein the surface decoration includes elements provided by any one of or any combination of weaving, printing or applied fabrics.

11. A sleeping bag as claimed in claim 1, wherein the surface decoration is applied directly to one or more surfaces of the sleeping bag.

12. A sleeping bag as claimed in claim 1, wherein the surface decoration comprises a separate cover for the sleeping bag.

13. A sleeping bag as claimed in claim 1, wherein the surface decoration is applied, at least in part by screen-printing.

14. A sleeping bag as claimed in claim 1, wherein at least part of the surface decoration is provided by pleats or tucks formed in an outer envelope of the sleeping bag.

15. A sleeping bag as claimed in claim 1, further including a pocket portion formed in an outer portion of the sleeping bag to permit over-printing of a corresponding portion of an outer surface of the sleeping bag.

16. A sleeping bag as claimed in claim 1, including leg portions terminating in end portions being formed from non-slip material.

17. A sleeping bag as claimed in claim 15, further including a pocket portion formed in an outer portion of the sleeping bag to permit over-printing of a corresponding portion of the outer surface of the sleeping bag.

18. A sleeping bag as claimed in claim 15, including leg portions terminating in end portions, said end portions including sole portions, and said sole portions being formed from non-slip material.

* * * * *